United States Patent [19]

Samarynov et al.

[11] 4,260,096

[45] Apr. 7, 1981

[54] METHOD FOR REDUCTION AND SIZING OF WELDED PIPES AND MILL FOR EFFECTING SAME

[76] Inventors: Jury V. Samarynov, prospekt Lenina, 61, kv. 14; Jury A. Mednikov, ulitsa Svobody, 145, kv. 19, both of Chelyabinsk; Alexandr S. Rozen, Gorodok ITR Metallurgicheskogo Zavoda, dom 19, kv. 11, Taganrog Rostovskoi oblasti, all of U.S.S.R.

[21] Appl. No.: 933,115

[22] Filed: Aug. 9, 1978

[51] Int. Cl.[3] ..... B23K 31/06; B21D 5/12

[52] U.S. Cl. ..... 228/158; 228/17; 72/235; 72/368

[58] Field of Search ..... 228/158, 17, 144, 146; 72/181, 235, 367, 368, 366; 219/8.5

[56] References Cited

U.S. PATENT DOCUMENTS

| | | | |
|---|---|---|---|
| 2,992,318 | 7/1961 | La Tour et al. | 219/8.5 |
| 3,075,484 | 1/1963 | Benteler | 228/158 |
| 3,590,622 | 7/1971 | Elge et al. | 228/158 |
| 3,708,354 | 1/1973 | Rowell | 219/8.5 |

FOREIGN PATENT DOCUMENTS

| | | | |
|---|---|---|---|
| 1206105 | 12/1965 | Fed. Rep. of Germany | 219/8.5 |

*Primary Examiner*—Daniel C. Crane

*Attorney, Agent, or Firm*—Haseltine and Lake

[57] ABSTRACT

Disclosure is made of a process for reduction and sizing of welded pipes, whereby a pipe is reduced in diameter in passes formed by rolls of alternating horizontal and vertical stands. The weld zone is deformed by portions of roll passes of an equal curvature. Disclosure is further made of a mill for effecting the above method, which comprises alternating horizontal and vertical stands with rolls whose working surface is defined by arcs of at least two radii. The radius of at least one of said arcs is equal to the radius of the roll welding pass. The apices of said arcs of an equal radius are in the same plane extending through the longitudinal axis of the mill and on the line of motion of the weld.

2 Claims, 15 Drawing Figures

METHOD FOR REDUCTION AND SIZING OF WELDED PIPES AND MILL FOR EFFECTING SAME

BACKGROUND OF THE INVENTION

1. Field of the Application

The present invention relates to pipe production processes and equipment and, more particularly, to a method and mill for reduction and sizing of welded pipes.

The invention is applicable to the reduction and sizing of pipes of continuous Fretz-Moon mills and electric-weld pipe mills.

Being applied to mills with two-high mill stands both in operation and under construction, the invention accounts for a greater strength of the weld and a more accurate pipe wall size, i.e. a more even pipe wall gauge.

2. Description of the Prior Art

Today, welded pipes are manufactured on a large scale in most industrially developed countries.

Continuous welding of pipes in combination with subsequent reduction and sizing is more productive and less expensive than the manufacture of seamless pipes. However, the mechanical and physical properties of the weld and areas adjacent to the weld are inferior to those of the base metal.

A major problem in this field is to find ways and means to improve the strength of the weld and bring the properties of welded pipes as close as possible to those of seamless pipes, while increasing the productivity and reducing the production costs.

At present, the commonest pipe production process comprises continuous welding with subsequent reduction of the hot pipe and is referred to as the Fretz-Moon pipe process.

According to this method, a band is heated to a temperature sufficiently high for a welding operation and formed in a first stand into a tubular blank, the forming angle being 220° to 270°. In a second stand, the blank is welded into a pipe which is reduced and sized in other stands.

The two-roll oval passes of the stands alternate so that the next pass is turned through 90° in relation to the previous pass.

The method under review is disadvantageous in that it causes a great non-uniformity of deformation in the pass tapers and cyclic bends of portions of a pipe passing in the plane of apices and tapers of the passes; this is due to the fact that the angle of convergence of the cross-sectional portions of the pipe varies from 180° at the apex of the pass to 160° at the pass taper.

This results in sharp bends of the pipe walls, which in turn, account for great tensile stresses of the outer layers of the pipe in the pass taper and of the inner layer of the pipe as the portion of the pipe passes on to the apex of the next pass.

As a weld is being formed, its strength is quite low. This is due to a high temperature of the edges being welded (which may be as high as 1,480° C), a low welding pressure and an increase of impurities in the weld zone. Under such conditions, cyclic bends of the portion of the pipe with the weld, which occur before the weld cools, reduce the weld strength and account for incomplete fusion due to the appearance of hot cracks on the outer and inner surfaces of the pipe.

The great non-uniformity of deformation in the tapers the oval passes accounts for an increased thickness, as well as an uneven cross-sectional gauge.

Another wide-spread pipe production process is the welding of pipes from cold band. Prior to the welding operation, the edges are heated by direct current, high-frequency current, etc. The welding is followed by cold or hot reduction.

This method, too, suffers from all the above disadvantages. Besides, the cold reduction hardens the pipe portions subjected to cyclic bending, which reduces the maximum permissible degree of drawing and reduces the efficiency of the pipe production process.

There is known a method for deformation of pipes in rolls whose passes are formed by conjugate arcs of three radii. This method is used to manufacture pipes of a rectangular section. As the pipe passes from pass to pass, two radii increase to infinity, whereby the planes of the tube rectangular in cross section are produced. The conjugate radius is reduced to the radius of the edge round-off of this profile.

However, the above method is not applicable to the reduction and sizing of round-section pipes.

There is known a method for reducing and sizing pipes in rolls with double-radius passes. This method is disadvantageous in that a pipe cannot be deformed so that its radius at the pass taper should be equal to the radius at the apex of the foregoing pass.

SUMMARY OF THE INVENTION

It is an object of the present invention to provide a process and mill for reducing and sizing welded pipes, which would improve the quality of welds.

It is another object of the invention to improve the accuracy of welded pipe sizes, i.e. to make the pipe gauges more even.

It is a further object of the invention to reduce the costs involved in the manufacture of welded pipes.

The foregoing objects are attained by providing a process for the reduction and sizing of welded pipes, whereby a pipe is reduced in diameter in passes formed by rolls of alternating horizontal and vertical stands, the weld zone being deformed, according to the invention, by portions of roll passes of an equal curvature.

The objects of the present invention are further attained by providing a mill for carrying out the above method, which comprises alternating hotizontal and vertical stands with rolls whose working surface is defined by conjugate arcs of at least two radii; according to the invention at least one of the arcs has a radius equal to that of the weld pass, the apices of the arcs of an equal radius being arranged in the same plane extending through the longitudinal axis of the mill, on the line of motion of the weld.

The method according to the invention for the reduction and sizing of welded pipes prevents cyclic bending of portions of a pipe section at the apices and tapers of the passes and thus prevents cyclic tensile stresses and deformations of the inner and outer layers of pipes, while preserving the tangential contractive stresses and deformations. This reduces the lack of fusion and increases the strength of welds.

Another positive effect of the invention is that the cross-sectional gauge is made more even. This is due to a lesser increase in the thickness of pipe walls at the pass tapers. In the case of cold reduction, the invention accounts for a more uniform hardening.

BRIEF DESCRIPTION OF THE ACCOMPANYING DRAWINGS

Other objects and advantages of the present invention will become more apparent from the following detailed description of preferred embodiments thereof, taken in conjunction with the accompanying drawings, wherein.

DETAILED DESCRIPTION OF THE INVENTION

Figure 1:
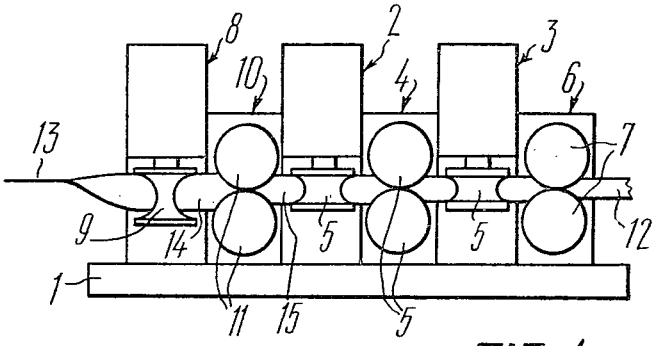
FIG. 1 is a view of a reduction and sizing mill combined with a forming and welding unit, in accordance with the invention.

According to the invention, the reduction and sizing mill comprises a bed 1 (FIG. 1) which carries alternating vertical reducing stands 2 and 3 and horizontal reducing stands 4 with rolls 5, and a sizing stand 6 with rolls 7. There may be more reducing and sizing stands mounted on the bed 1.

The reduction and sizing mill is combined with a forming and welding unit comprising a forming stand 8 with rolls 9 and a welding stand 10 with weld rolls 11.

Figure 2:
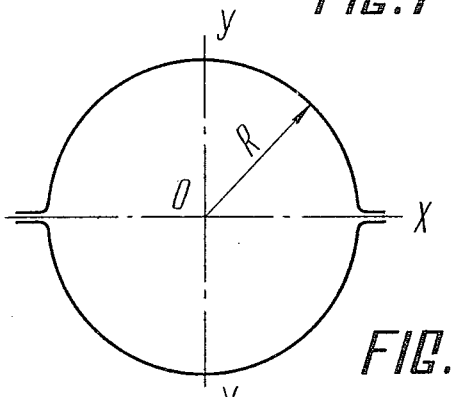
FIG. 2 is a view of a single-radius round pass.
Figure 3:
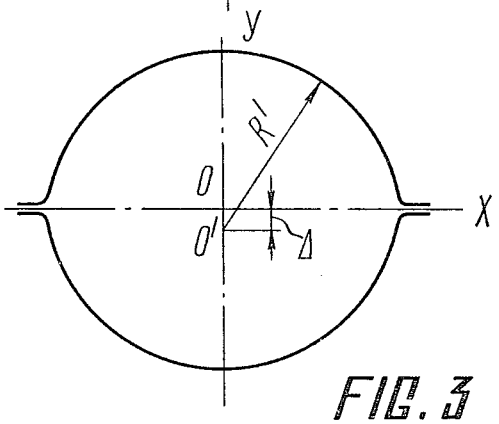
FIG. 3 is a view of a single-radius oval pass.

In the plane of their axes of rotation, the working surfaces of the rolls 5, 7, 9 and 11 form passes. The passes may be single-radius round (FIG. 2) and single-radius oval (FIG. 3), three-radius (FIG. 4) and two-radius (FIG. 5).

The single-radius round pass of the rolls (FIG. 2) is described by a single radius R drawn from the pass center O. The single-radius oval pass (FIG. 3) is described by a single radius R' drawn from the center O' which is displaced in relation to the pass center O along the y-axis by a value $\Delta$. X-axis is one of the pass disjunction.

The three-radius pass (FIG. 4) is defined by arcs of three radii described by a radius $R_1$ of the apex, drawn from the center $O_1$ found on the axis $y_1$, a radius $R_3$ of the taper, drawn from the center $O_3$ found on the axis x, and a conjugate radius $R_2$, drawn from the center $O_2$ found at the intersection of the radii $R_1$ and $R_3$ drawn to points of conjugation "a" and "b". The radius $R_1$, drawn to the conjugation point "a", is at an angle $\alpha$ to the y axis. The radius $R_3$, drawn to the conjugation point "b", is at an angle $\beta$ to the x axis.

The two-radius pass (FIG. 5) is defined by arcs of two radii, i.e. the apex radius $R_1'$ drawn from the center $O_1'$ found on the minor axis y and the taper radius $R_2'$ drawn from the center $O_2$ found on the major axis x. The arcs of the two radii conjugate at point "a'" found on a straight line drawn through the centers $O_1'$ and $O_2'$ at an angle $\alpha$.

Figure 4:
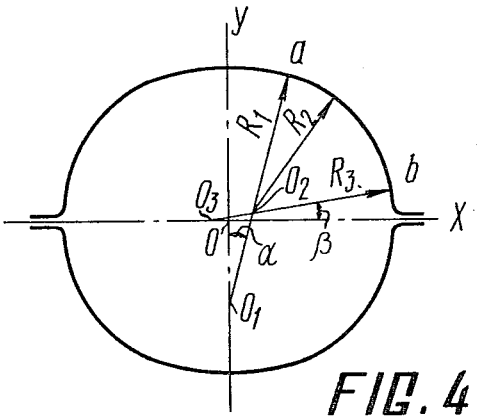
FIG. 4 is a view of a three-radius pass.
Figure 5:
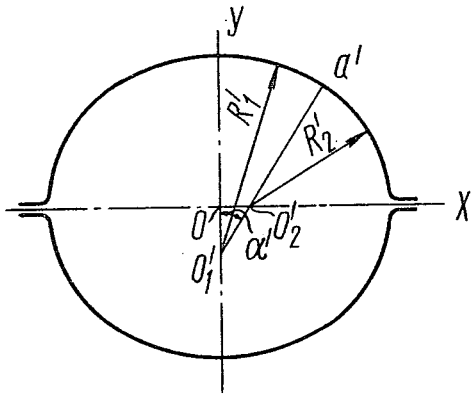
FIG. 5 is a view of a two-radius pass.

The pass (FIG. 6) of the weld rolls 11 (FIG. 1) may be round and oval single-radius and oval (FIGS. 1 and 2); it may also be two-radius (FIG. 5) and three-radius (FIG. 4).

Figure 6:
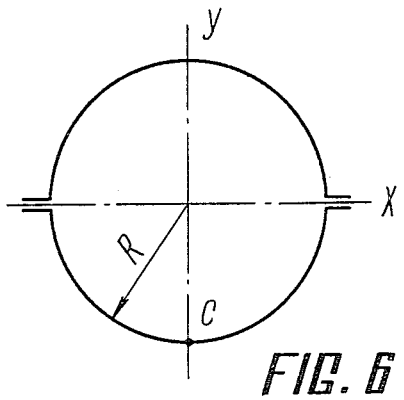
FIG. 6 is a view of a horizontal weld pass, showing the position of the weld (poinc c) in said horizontal weld pass of the stand 10 of FIG. 1.

The working surfaces of the rolls 5 (FIG. 1), which form the passes (FIGS. 7, 8 and 9) of the reducing stands 2, 3 and 4 (FIG. 1), are defined by conjugate arcs of at least two radii; at least one of the arcs of each pass, i.e. bb" (FIG. 7), aa' or aa" (FIG. 8), and b,b," (FIG. 9), is described by the radii $R_3$ (for the passes of the vertical stands) (FIGS. 7 and 9), $R_1$ or $R_1'$ (for the passes of the horizontal stands) (FIG. 8), which are equal to the radius R of the weld pass at the point "c" of the weld location (FIG. 6). The apices of the arcs bb", aa" and $b_1b_1$" of an equal radius are arranged in the same plane extending through the longitudinal axis of the mill, on the line of motion of the weld, which traverses the planes of the passes at the point "C".

The pass (FIG. 10) of the rolls 7 (FIG. 1) of the last sizing stand 6 is a circumference with a radius $R_4$ (FIG. 10) equal to a prescribed radius of a finished pipe 12 (FIG. 1).

Consider now the following examples illustrating the way the mill is used to carry out the method for reduction and sizing of welded pipes in accordance with the invention.

Figure 7:
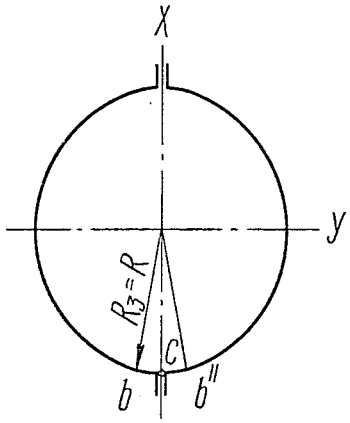
FIG. 7 shows the position of the weld (point b) and the equal-radius arc in the pass of the vertical reducing stand 2 of FIG. 1.

A heated band 13 (FIG. 1) is formed in the rolls 9 of the forming stand 8 into a tubular blank 14. (A cold band is formed in the rolls of a plurality of stands). The tubular blank 14 thus formed is welded into a pipe 15 in the pass of the rolls 11 as shown in FIG. 6. The welded pipe 15 (FIG. 1) is reduced in the pass of the rolls 5 of the stand 2 as shown in FIG. 7. In order to avoid bending of the pipe wall with the weld at point "C", as well as tensile deformations in the weld, close to the outer surface, and an increased thickness in the taper zone, the pipe is deformed in a three-radius pass as shown in FIGS. 4 and 7. In this pass, the taper arc bb" has a radius $R_3$ which is equal to the radius R of the weld pass at point "c" (FIG. 6).

Figure 8:
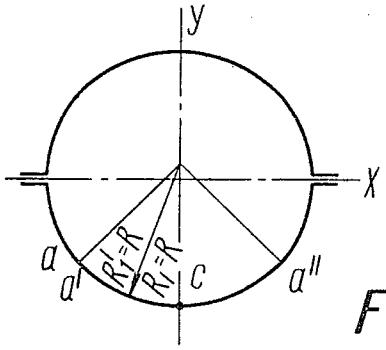
FIG. 8 shows the position of the weld and the equal-radius arc in the pass of the horizontal reducing stand 4 of FIG. 1.

The pipe is then reduced in the stand 4 with a horizontal roll pass as shown in FIG. 8.

In order to rule out tensile stresses and deformations of the weld close to the internal surface of the pipe, the roll pass of this stand, which may be two-radius and three-radius, is selected so that the arc aa" (for a three-radius pass) is described by the radius $R_1$ equal to the radius R of the weld pass, or so that the arc a'a" (for a two-radius pass) is described by the radius $R_1'$ which is also equal to the radius R of the weld pass.

Figure 9:
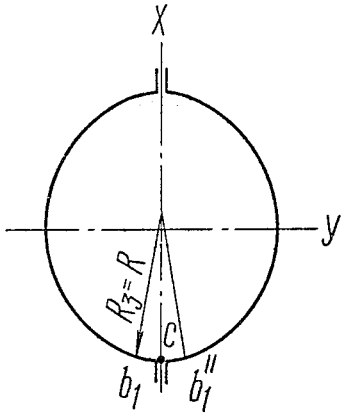
FIG. 9 shows the position of the weld and the equal-radius arc in the pass of the vertical reducing stand 3 of FIG. 1.

The pipe is further reduced in the stand 3 (FIG. 1) with the rolls 5 having a three-radius pass as shown in FIGS. 4 and 9; the portion with the weld is deformed by the pass portion with the arc $b_1b_1$" having a radius $R_3$ equal to the radius R of the weld pass.

Figure 10:
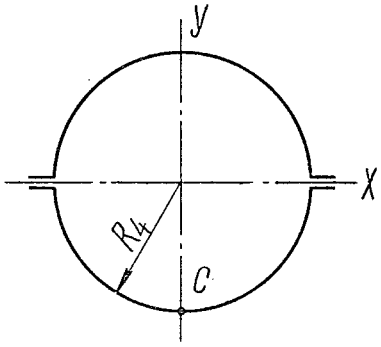
FIG. 10 shows the position of the weld in the round pass of the last stand of FIG. 1.

The rolls 7 of the last sizing stand 6 (FIG. 1) size the pipe into a round with a radius $R_4$ equal to the prescribed radius of the finished pipe, as shown in FIG. 10.

In case of a greater number of reducing stands used in the process, the reduction is effected in passes designed as described above.

In order to carry out the method according to the invention, the passes of the rolls, whereof the x axis is in the plane extending through the rolling axis and the weld, must only be three-radius passes. The passes, whereof the axis is perpendicular to the plane extending through the rolling axis and the weld, may be both two- and three-radius.

A cold band is formed in rolls of a plurality of stands.

Figure 11:
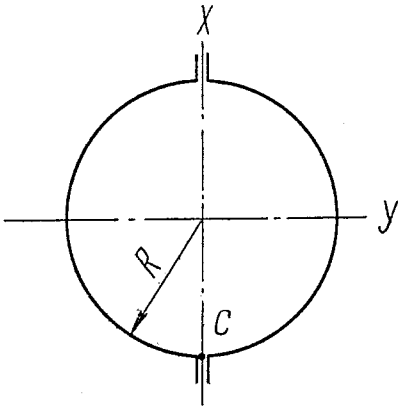
FIG. 11 is a view of a vertical weld pass, showing the position of the weld in said vertical weld pass.
Figure 14:
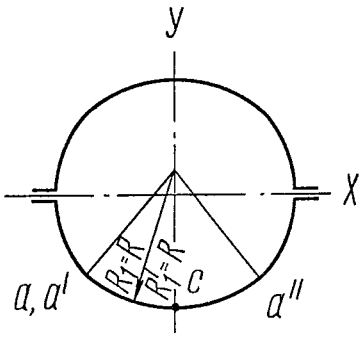
FIGS. 12, 13 and 14 show the position of the weld and the equal-radius arc in passes of reducing stands with reference to the vertical weld pass.
Figure 12:
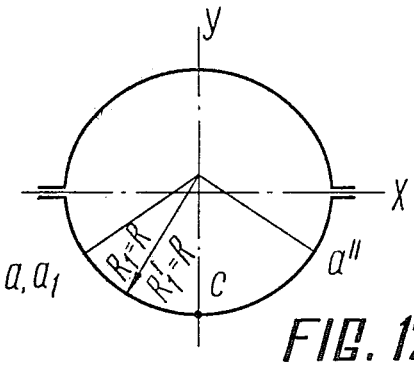

With the use of high-frequency and other types of electric heating of the edges of a formed blank, the welding operation is normally carried out in rolls with a vertical arrangement of the axes (FIG. 11). In such cases, the reduction is effected as described above for the case of a horizontal welding stand. The difference lies in a changed position of the passes which are next to the weld pass (FIGS. 12, 13, 14 and 15). In the horizontal stand arranged after the welding stand, the pipe is reduced in a pass which may be both two- and three-radius due to the fact that the x axis is perpendicular to the plane extending through the rolling axis and the weld line (FIG. 12). The arc aa″ has a radius $R_1=R$ (for a three-radius pass); or the arc a′a″ has a radius $R_1'==R$ (for a two-radius pass).

Figure 13:
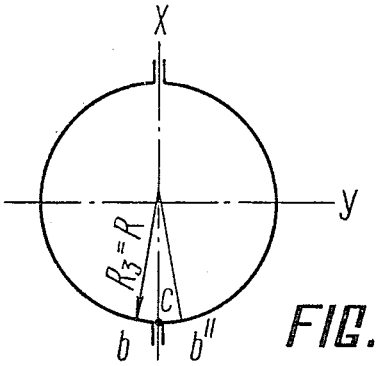

The pipe is then reduced in a vertical three-radius pass as shown in FIGS. 4 and 13; in this pass, the taper arc bb″ has a radius $R_3$ equal to the radius R of the weld pass at point "c" of the weld location (FIG. 11).

In the next horizontal stand, the reduction of the pipe may be effected by both a two-radius pass (FIGS. 5 and 14), whereof the arc a′a″ is described by a radius $R_1'$ equal to the radius R of the weld pass, and by a three-radius pass (FIGS. 4 and 14), whereof the arc aa″ is described by a radius $R_1$ equal to R.

Figure 15:
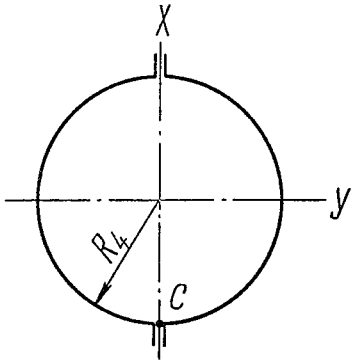
FIG. 15 is a view of a round pass of a sizing stand.

In the last sizing stand, the pipe is sized into a round of a radius $R_4$ equal to the prescribed radius of the finished pipe (FIG. 15).

According to the method of this invention, the reduction may be carried out both with the use of all the stands of the mill and with the use of only some of the stands incorporated in the mill. For example, if the only problem with the use of a conventional continuous furnace mill welding is to improve the weld strength, it is enough the reduce the pipe in the stands of the forming and welding mill (six, eight stands), whereupon the weld temperature is reduced to the temperature of the whole of the pipe, and the weld strength becomes almost equal to that of the base metal. In the case of a tube-stratch-reducing mill, the reduction is performed in the conventional manner.

However, if the task is to increase the weld strength and make the cross-sectional gauge more even, or if the weld strength varies over the length of the mill, the reduction according to the method of this invention is carried out with the use of all the stands of the mill.

Rolls with passes for carrying out the method according to the invention can be produced on conventional roll-turning machines with profile tools or on programme controlled machines.

What is claimed is:

1. An improved process for the reduction and sizing of welded round pipes, wherein a pipe is reduced in the diameter in passes through rolls having alternating horizontal and vertical stands along a mill path, each horizontal stand having a pair of opposed reducing rolls disposed with their axes vertically oriented and each vertical stand having a pair of opposed reducing rolls disposed with their axes horizontally oriented the improvement comprising: advancing said pipe through a roll welding pass thereby welding sheet material into a round pipe, advancing said round welded pipe through said alternating horizontal and vertical stands whereby the stands are arranged with the axes of the rolls in each stand oriented 90° with respect to each preceding stand, and deforming said pipe at its weld zone by engaging working surfaces of rolls in each stand against the weld with the curvature of the working surfaces being equal to one another in a plurality of stands.

2. An improved mill for effecting the process for the reduction and sizing of round welded pipes, having alternating horizontal and vertical stands arranged along a mill path with each stand having opposed reducing rolls and the stands arranged with the axes of the rolls in each stand oriented 90° with respect to the preceding stand and with the rolls in each stand having respective working surfaces for engaging the pipe weld and being defined by conjugate arcs of at least two radii, the improvement comprising: a roll welding pass for welding a strip into a round pipe and disposed along the mill path and having a roll welding radius, said reducing rolls having at least one of said arcs defined by a radius which is equal to the radius of roll welding pass of said rolls; and the apices of said arcs of an equal radius, being in the same plane extending through the longitudinal axis of the mill along the line of motion of the weld and the curvature formed by the conjugate arcs in the working surfaces of each stand being equal to one another in a plurality of stands.

* * * * *